United States Patent [19]

Monsod, Jr.

[11] 4,075,373

[45] Feb. 21, 1978

[54] METHOD FOR LINING CAR, TRUCKS AND SHIP BODIES, STEEL TUBES, PLATES AND OTHER METALLIC BODIES TO PROTECT SAME FROM ABRASION, CORROSION AND HEAT

[76] Inventor: Godofredo G. Monsod, Jr., 39 K-4th Street, Kamuning, Quezon City, Philippines

[21] Appl. No.: 725,064

[22] Filed: Sept. 21, 1976

Related U.S. Application Data

[63] Continuation-in-part of Ser. No. 527,391, Nov. 26, 1974, abandoned.

[30] Foreign Application Priority Data

Nov. 26, 1973 Philippines ..... 15256

[51] Int. Cl.[2] ..... B05D 3/02; B05D 3/12; B05D 3/10

[52] U.S. Cl. ..... 427/327; 260/42.36; 427/331; 427/388 R; 427/413; 428/515

[58] Field of Search ..... 260/42.36; 427/202, 427/299, 327, 331, 388, 413; 428/466, 515

[56] References Cited

U.S. PATENT DOCUMENTS

| | | | |
|---|---|---|---|
| 2,418,025 | 3/1947 | Garvey | 427/413 |
| 2,996,468 | 8/1961 | Powers et al. | 260/42.36 |
| 3,704,274 | 11/1972 | Callan | 260/42.36 |
| 3,789,050 | 1/1974 | Loricchio | 260/42.36 |
| 3,941,732 | 3/1976 | Yukuta et al. | 260/42.36 |

*Primary Examiner*—Ralph S. Kendall
*Assistant Examiner*—R. Eugene Varndell, Jr.
*Attorney, Agent, or Firm*—Sughrue, Rothwell, Mion, Zinn and Macpeak

[57] ABSTRACT

A method for coating or lining metal surfaces, such as car or truck bodies, by applying plural layers of a premixed, defined rubber composition and allowing the rubber coating to cure in situ.

4 Claims, No Drawings

METHOD FOR LINING CAR, TRUCKS AND SHIP BODIES, STEEL TUBES, PLATES AND OTHER METALLIC BODIES TO PROTECT SAME FROM ABRASION, CORROSION AND HEAT

This application is a continuation-in-part of application Ser. No. 527,391, filed Nov. 26, 1974 now abandoned.

FIELD OF INVENTION

This invention relates to a method for providing metal bodies, tubes or plates with protection against abrasion, corrosion and heat. In particular, the present invention relates to a method for lining metal bodies, plates or tubes with a rubber material, said rubber lining being coated and cured in situ on the surface of the metal being lined.

BACKGROUND OF THE INVENTION

It is a well known method to protect steel and iron products from abrasion and corrosion by coating their metal surfaces, with coating compositions containing tar or asphalt. This is common in the automotive industry today where cars and truck bodies, particularly the floors, fenders and parts underneath the vehicles are coated with the so called undercoating compositions. The undercoat thus applied serves to protect the metal surfaces exposed to dirt and water from corrosion and to some extent from abrasion or heat when the coating applied is thick.

It has been observed, however, that by the aforedescribed method, no lasting protection for the metal is afforded and at best, good protection extends to a period of about eight to twelve months only. One surprising observation is that if the vehicle is not recoated after this period, cracks on the undercoating begin to appear and then solid little particles of hard and brittle undercoat compositions begin to peel off. Under this condition, water and dirt enter into the jackets thus formed when the vehicle is used under normal road conditions of sun and rain. The process of rust formation and corrosion is even more accelerated rather than retarded and the purpose for which the coating is applied is totally defeated.

The state of the art in regard to ships and other sea crafts is somewhat different. The primary objective sought to be attained in cases of water vessels is resistance to corrosion caused by the salty sea water. To protect ship bodies and other ship metal parts exposed to salt water from corrosion, special marine paint compositions are applied. Certain drawbacks, however, are evident in this method. In order to obtain satisfactory corrosion prevention results, the ship must maintain a continuous painting process during the lifetime of the ship. Moreover, dents, holes and abrasion are not prevented by these paint compositions as the vessels operate under normal conditions of loading, docking and marine travel.

SUMMARY OF THE INVENTION

It is therefore, the object of the present invention to provide a novel process whereby truck and car bodies as well as other metal surfaces can be coated or lined with a material which will endure for an indefinite period of time thereby protecting the metal body from abrasion corrosion and, at the same time, serving as a heat insulator which is more or less permanent in nature.

It is also another object of the present invention to protect bodies of ships and other sea going vessels from corrosion and abrasion by lining their bodies exposed to sea water with a rubber material which is applied as a coating thereto and thereafter cured in situ.

Other objects of this invention will become apparent as one reads the description of the process which will hereinafter be described.

DETAILED DESCRIPTION OF INVENTION

The method of the present invention primarily is based on the principle of applying to a metal surface several layers of coating of a premixed special rubber composition and then allowing the rubber coating to cure in situ.

The metal to be coated must necessarily be first cleaned, preferably with the use of a machine grinder to provide a smooth clean surface on which is applied a special coating of an adhesive composition to activate the same preparatory to the application of the rubber lining. Subsequently the metal surface is coated with a solvent mixture comprising 80 parts ethylene dichloride, 10 parts acetone and 10 parts benzol, which composition is allowed to dry. The metal is then coated with three rubber cement coatings having the formula: 100 parts isobutylene isoprene rubber, 5 parts polyacrylate rubber, 5 parts zinc oxide, 0.5 parts heavy magnesium oxide, 2 parts sulfur, 0.5 parts dibenzotiazoledisulphide and 1 part tetramethylthiuramdisulphide. Each rubber cement coating is allowed to dry before applying the next coating.

The rubber coatings described in more detail below are applied to the metal after the last rubber cement coating has dried. The rubber coating compositions must be premixed and formulated in various forms and proportions of ingredients depending upon the kind or nature of protection the metal should be best protected. After applying one rubber coating and allowing it to dry, a second rubber coating is applied which, after drying, is overcoated with a final coating of the rubber cement composition described above. This final rubber cement coating is allowed to dry and the resulting coating composite self cures in situ. In general, the rubber compound can be divided into three general categories, classified according to the nature of protection for which it is best suited: abrasion and corrosion resistance; chemical resistance and heat resistance.

ABRASION AND CORROSION RESISTANCE

The following Compositions I and II exhibit good abrasion resistance and corrosion resistance.

Composition I

| | |
|---|---|
| Isobutylene isoprene rubber (BUTYL 218) | 100 parts |
| HAF Black (high abrasion furnace black) | 50 parts |
| MT Black (medium thermal black) | 50 parts |
| Antioxidant (FLEXZONE 845 Ashland Chemical Co.) | 20 parts |
| N-methyl-N,4-dinitrosoaniline (ELASTOPAR) | 1 part |
| Zinc oxide | 5 parts |
| Stearic acid | 1 part |
| Accelerators: | |
| Diethylammonium diethyldithiocarbamate (DEDC) | 2 parts |
| Dibenzothiazoledisulphide (MBTS) | 0.5 parts |
| Sulfur | 1 part |

To prepare the coating composition the foregoing materials are thoroughly mixed in a compounding vat under sufficient heat to render the mixture viscous.

Composition II

| | |
|---|---|
| Isobutylene isoprene rubber | 100 parts |
| Polyacrylate rubber | 5 parts |
| Zinc oxide | 5 parts |
| Heavy magnesium oxide | .5 parts |
| Sulfur | 2 parts |
| Accelerators: | |
| Dibenzothiazoledisulphide | 0.5 parts |
| Tetramethylthiuramdisulfide | 1.0 parts |

Composition II may be compounded and coated on a metal surface to cure as Composition I.

CHEMICAL RESISTANCE

The inventor has found that the following Composition III exhibits good chemical resistance.

Composition III

| | |
|---|---|
| Isobutylene isoprene rubber (BUTYL 218) | 100 parts |
| HAF Black | 10 parts |
| Zinc oxide | 10 parts |
| $CaCO_3$ | 60 parts |
| Stearic acid | 1.5 parts |
| Diethyleneglycol | 2 parts |
| Accelerators: | |
| Tetramethylthiuramdisulphide (TMTDS) | 2 parts |
| Sulfur | 1 part |

The foregoing ingredients were mixed as in Composition I to prepare the coating composition.

HEAT RESISTANCE

The inventor has found that the following Composition IV exhibits good heat resistance.

Composition IV

| | |
|---|---|
| NEOPRENE TW, Dupont Corp. | 50 parts |
| NEOPRENE TRT, Dupont Corp. | 50 parts |
| Antioxidant (AKROFLEX DAZ, Ashland Chemical Co.) | 3 parts |
| Light magnesium oxide (MAGLITE D) | 2 parts |
| Stearic acid | 0.5 parts |
| MT Black | 11.7 parts |
| SRF Black (semi-reinforcing black) | 40 parts |
| Plasticizer and Extender (SUNDEX 790, Ashland Chemical Co.) | 32.5 parts |
| Butyloleate | 12.5 parts |
| Zinc oxide | 5 parts |
| Accelerators: | |
| 2-mercaptoimidazoline (NA-101) | 1.25 parts |
| N-cyclohexyl-2-benzothiazole (CONAC S) | 1.5 parts |

The coating composition is prepared by thoroughly mixing the foregoing ingredients in a compounding vat as in Composition I.

Each of the compositions described above may be coated or applied to a metal surface and cured in situ.

While these compositions have been set forth it should be apparent that the invention is not limited to these compositions. Thus to obtain linings of greater toughness and corrosion resistance additional synthetic rubber having high toughness and resistancy properties may be used. For heat resistance, on the other hand, scrap rubber may be used.

HAF Black, MT Black and SRF Black are examples of carbon blacks suitable for use in the present invention.

Suitable accelerators for use in the invention may be selected from diethylammino diethyldithiocarbamate, dibenzothiazoledisulphide, tetramethylthiuramdisulphide, 2-mercaptoimidazoline and N-cyclohexyl-2-benzothiazole.

Suitable fillers may be selected from zinc oxide, calcium carbonate, magnesium oxide.

Likewise FLEXZONE 845, Ashland Chemical Co. and AKROFLEX DAZ, Ashland Chemical Co are exemplary of antioxidants suitable for use in the invention.

The compositions may likewise contain softening agents, modifiers and extender oils.

I claim:

1. A method for lining metal bodies and surfaces to protect the same from abrasion, corrosion and heat comprising:

(a) scrubbing or sanding the metal surface to be lined until the metal surface is thoroughly cleaned and rendered smooth;

(b) applying on the metal surface a coating of a solvent mixture comprising 80 parts of ethylene dichloride, 10 parts acetone, 10 parts benzol and thereafter allowing said applied solvent mixture to dry;

(c) applying on the resulting coated metal surface three (3) coatings of a rubber cement mixture having the following formula:

| | |
|---|---|
| Isobutylene Isoprene Rubber | 100 parts |
| Polyacrylate Rubber | 5 parts |
| Zinc Oxide | 5 parts |
| Heavy Magnesium Oxide | 0.5 parts |
| Sulfur | 2 parts |
| Dibenzothiazoledisulphide | 0.5 parts |
| Tetramethylthiuramdisulphide | 1 part |

drying the rubber cement coat, before applying each subsequent coating of said rubber cement.

(d) applying a first coating of a compounded rubber composition essentially containing rubber, effective amounts of modifiers, extenders and accelerator of a thickness of about 0.02 inches uniform throughout the entire surface and then pressing the thus applied coating on to the contours and shape of the metal body, thereafter applying a coating of the ethylene dichloride solvent mixture of step (b) and then allowing the same to dry;

(e) applying a second and final coating of the rubber composition of step (d) of a uniform and desired thickness and then applying a final coating of a rubber cement mixture of step (c) and allowing the same to dry, and (f) finally, setting the rubber lining to self cure in situ.

2. The method for lining metal bodies as defined in claim 1 wherein the rubber composition applied in step (d) is formulated as follows:

| | |
|---|---|
| Isobutylene Isoprene Rubber | 100 parts |
| HAF Black | 50 parts |
| MT Black | 50 parts |
| Antioxidant | 20 parts |
| Zinc Oxide | 5.0 parts |
| N-methyl-N,4-dinitrosoaniline | 1 part |
| Stearic Acid | 1.0 parts |
| Diethylamminodithiocarbamate | 2.0 parts |
| Dibenzothiazoledisulphide | 0.5 parts |
| Sulfur | 1.0 parts. |

3. The method for lining metal bodies as defined in claim 1 wherein the rubber composition applied in step (d) is formulated as follows:

| | |
|---|---|
| Isobutylene Isoprene Rubber | 100 parts |
| HAF Black | 10 parts |
| Zinc Oxide | 10 parts |
| Stearic Acid | 1.5 parts |
| Diethylene Glycol | 2.0 parts |
| Tetramethylthiuramidsulfide | 2.0 parts |

-continued

| | |
|---|---|
| Sulfur | 1.0 parts. |

4. The method for lining metal bodies as defined in claim 1 wherein the rubber composition applied in step (d) is formulated as follows:

| | |
|---|---|
| Neoprene | 100 parts |
| Antioxidant | 3 parts |
| Light Magnesium Oxide | 2 parts |
| Stearic Acid | 0.5 parts |
| MT Black | 11.7 parts |
| SRF Black | 40 parts |
| Extender Oil | 32.5 parts |
| Zinc Oxide | 5 parts |
| Butyloleate | 12.5 parts |
| 2-mercaptoimidazoline | 1.25 parts |
| N-cyclohexyl-2-benzothiazole | 1.5 parts. |

* * * * *